US007066842B2

(12) United States Patent
Sato et al.

(10) Patent No.: US 7,066,842 B2
(45) Date of Patent: Jun. 27, 2006

(54) GOLF BALL

(75) Inventors: Katsunori Sato, Chichibu (JP); Atsuki Kasashima, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 10/972,051

(22) Filed: Oct. 25, 2004

(65) Prior Publication Data

US 2006/0089211 A1 Apr. 27, 2006

(51) Int. Cl.
*A63B 37/12* (2006.01)

(52) U.S. Cl. ..... 473/383

(58) Field of Classification Search ..... 473/378–385
See application file for complete search history.

(56) References Cited

U.S. PATENT DOCUMENTS 6,290,615 B1 9/2001 Ogg

*Primary Examiner*—Raeann Gorden
(74) *Attorney, Agent, or Firm*—Sughrue Mion, PLLC

(57) ABSTRACT

A golf ball having a plurality of dimples demarcated by edges on the ball's surface, characterized in that the dimples each assume a non-circular shape (as viewed form above) with mutually intersecting curved edge elements of the edges and at least one of these non-circular dimples is demarcated by the edge whose edge element bulges toward the inside of the dimple. The golf ball has improved aerodynamic performance due to dimples and achieves a long flying distance.

8 Claims, 4 Drawing Sheets

GOLF BALL

BACKGROUND OF THE INVENTION

The present invention relates to a golf ball excellent in flight performance.

It is a well-known fact that a golf ball should have a high rebound resilience and a low aerodynamic resistance attributable to dimples arranged on its surface so that it flies over a long distance after hitting. For reduction of aerodynamic resistance, there have been proposed several methods for arranging dimples on the ball surface as densely and uniformly as possible.

As shown in FIG. 7, a golf ball (G) usually has dimples (s) which are circular dents as viewed from above. For such circular dimples (s) to be densely arranged, it is necessary to narrow down the flat part or land (t) separating adjoining dimples from each other. Even though the flat part or land (t) is infinitely narrow, there still exists a triangular or rectangular flat part of certain size in the area surrounded by three or four dimples. On the other hand, it is essential to arrange dimples as uniformly as possible on the ball's spherical surface. This necessitates making a compromise between the density and the uniformity of dimple arrangement.

One conventional way to achieve the object of arranging dimples densely and uniformly was to arrange two to five kinds of dimples differing in diameter assuming that the ball's spherical surface is a polyhedron (e.g., regular octahedron or icosahedron).

However, as far as dimples are circular, the total area of dimples practically accounts for only 75% or so in the surface area of the sphere, with the remainder (25%) being the area of flat parts or land.

On the other hand, U.S. Pat. No. 6,290,615 discloses a new golf ball which has, in place of conventional dimples, a number of small hexagonal segments divided by thin ridges extending in a lattice pattern on the smooth spherical surface.

However, such small hexagonal segments (which are not dimples) constitute the spherical surface whose center coincides with the center of the golf ball. Therefore, they do not reduce aerodynamic resistance so effectively.

SUMMARY OF THE INVENTION

The present invention was completed in view of the foregoing. It is an object of the present invention to provide a golf ball which has improved aerodynamic performance due to dimples and achieves a long flying distance.

After their extensive researches to achieve the above-mentioned object, the present inventors found that the object is achieved by a golf ball having a plurality of dimples demarcated by edges on the ball's surface, the dimples being formed such that each assumes a non-circular shape (as viewed form above) which is enclosed by mutually intersecting curved edge elements constituting the edges and at least one of these non-circular dimples is demarcated by the edge whose edge element bulges toward the inside of the dimple. The golf ball according to the present invention has dimples of novel design formed on its surface, and a combination of these dimples differing in shape produces the effect of further improving aerodynamic performance. Therefore, it realizes an extremely increased flying distance. The present invention is based on this finding.

The flight performance of a golf ball depends largely on the total area occupied by dimples in the ball's surface. The greater the total area of dimples, the better the aerodynamic performance. The golf ball of the present invention is characterized by the shape of each dimple's edge. Each dimple surrounded by edges assumes a novel, unique shape. Such dimples increase their total area on the ball's surface and permit their uniform and balanced arrangement. This is the reason for the greatly increased flying distance.

The present invention provides a golf ball specified as follows.

[1] A golf ball having a plurality of dimples demarcated by edges on the ball's surface, characterized in that the dimples each assume a non-circular shape (as viewed form above) with mutually intersecting curved edge elements of the edges and at least one of these non-circular dimples is demarcated by the edge whose edge element bulges toward the inside of the dimple.

[2] The golf ball of [1], in which the curved edge element assumes an arcuate shape.

[3] The golf ball of [1], in which the curved edge elements joined together form at least one wavy great circle on the ball's surface.

[4] The golf ball of [3], in which the wavy great circle coincides with the equator line of the ball.

[5] The golf ball of [1], in which the edge has a cross section which assumes an arcuate shape.

[6] The golf ball of [1], in which the dimples have the maximum depth of 0.1 to 0.5 mm.

[7] The golf ball of [1], in which the dimples include non-circular ones demarcated by three curved edge elements.

[8] The golf ball of [1], in which the dimples include non-circular ones demarcated by four curved edge elements.

DETAILED DESCRIPTION OF THE PREFERRED EMBODIMENTS

The invention will be described below in more detail with reference to the accompanying drawings. The golf ball according to the present invention has a number of dimples each demarcated by edges on its surface. The dimples are formed such that each assumes a non-circular shape (as viewed form above) enclosed by mutually intersecting curved edge elements (normally three or more) constituting the edges, and at least one of these non-circular dimples is demarcated by the edge whose edge element bulges toward the inside of the dimple.

The dimples may be arranged uniformly on the ball's surface by assuming that the ball is a polyhedron (such as icosahedron, dodecahedron, and octahedron) to be turned about its symmetric axis (such as trigonal axis and pentagonal axis). In this way it is possible to form dimples by utilizing round flat parts (as viewed above).

The golf ball of the present invention should be molded such that the parting line of the mold coincides with the highest point of the flat part. Therefore, the mold should be designed such that flat parts constitute at least one great circle when they are joined together. The joined flat parts may take on a wavy curve or sinusoidal curve, which is easy to machine by trimming.

The total number of dimples to be formed on the ball's surface should be no less than 100, preferably no less than 250, and no more than 500, preferably no more than 450.

The mold to mold the golf ball may be produced by cutting the three-dimensional surface pattern directly on the reverse master mold or in the mold cavity by using 3DCAD·CAM. Incidentally, the support pins to hold the core (with or without the intermediate layer) at the center of the mold cavity when the core is enclosed by the cover may have round or non-round ends, depending on the shape of dimples.

The total space of dimples that accounts for the entire volume of the ball will be explained with reference to FIG. 3. The volume of the ball is based on the assumption that the ball is a dimple-free sphere. The space of dimples is defined as the space surrounded by the concave surface of dimples and the circumferential surface of the ball as a dimple-free sphere. The ratio of the space of dimples to the volume of the ball (dimple space occupancy) should be no less than 1.1%, preferably no less than 1.2%, more preferably no less than 1.25%, and no more than 1.6%, preferably no more than 1.55%, more preferably no more than 1.5%. With the dimple space occupancy specified above, the golf ball flies along a desired trajectory (without sharp rise or drop) when it is hit by a driver for a long flying distance.

Figure 1:
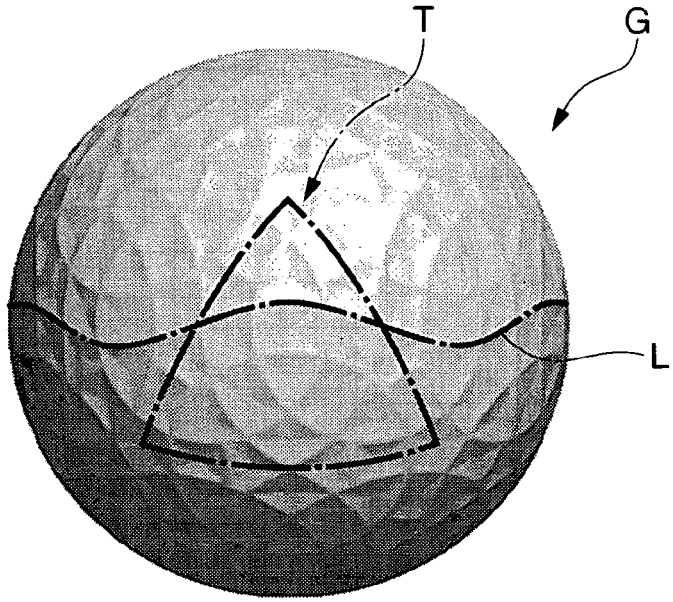
FIG. 1 is a photograph showing the golf ball pertaining to Example 1 of the present invention.
Figure 2:
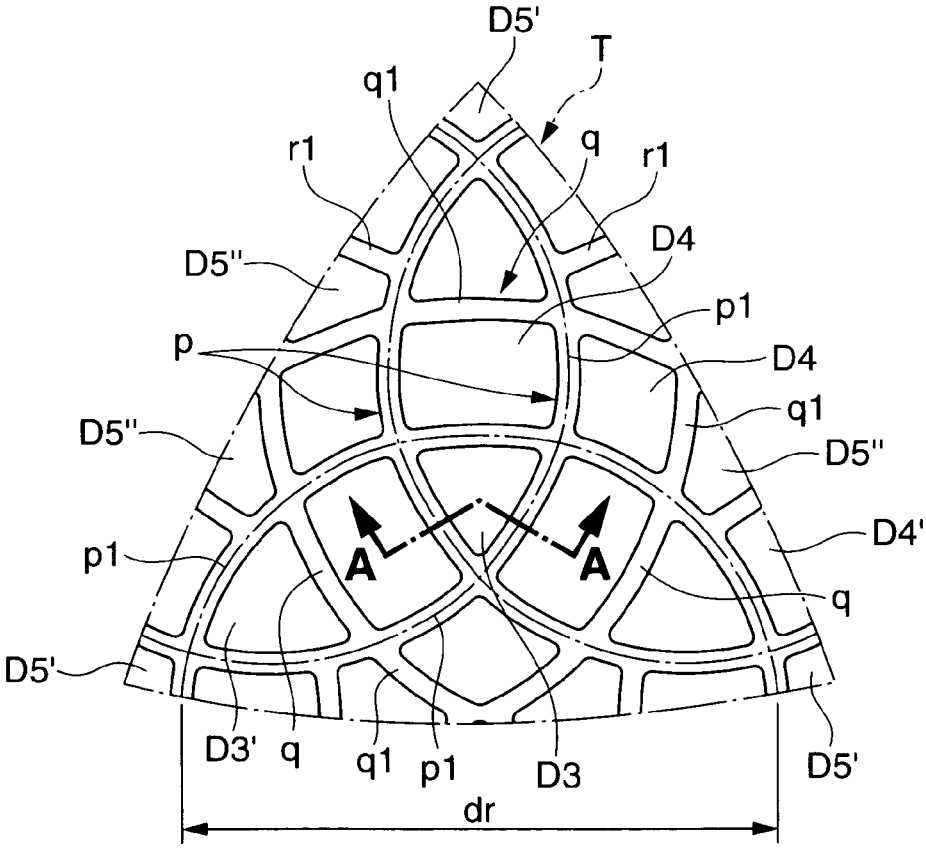
FIG. 2 is a partly enlarged view of the surface of the golf ball shown in FIG. 1.

FIG. 1 is a photograph showing the golf ball pertaining to Example 1 of the present invention. FIG. 2 is a partly enlarged diagram of the photograph shown in FIG. 1. This enlarged part represents one of twenty unit triangles (T) forming the ball surface which is regarded as a spherical icosahedron. All the dimples on the ball surface are arranged by repeating the pattern of the unit triangle (T). The configuration within each unit triangle (T) will be described with reference to FIG. 2.

According to Example 1, the configuration within each unit triangle consists of more than one semicircular edge (p), more than one arcuate edge (q), and more than one straight edge element (r1). The semicircular edge (p) has its center at the middle point of each side of the unit triangle (T) as a constituent of the spherical icosahedron. Two or more semicircle edges (p) demarcate dimples. The arcuate edge (q) runs outside (in the radial direction) and parallel to the semicircular edge (p), forming a great circle passing through each middle point of two sides of the unit triangle (T). The straight edge element (r1) is a part of the straight edge branching outward (in the radial direction) from the semicircular edge (p). One unit triangle (T) has three semicircular edges (p), three arcuate edges (q), and six straight edge elements (r1).

According to Example 1, one unit triangle (T) contains non-circular dimples differing in shape and number depending on the combination of the semicircular edge elements (p1) constituting the semicircular edge (p), the arcuate edge elements (q1) constituting the arcuate edge (q), and the straight edge elements (r1). Incidentally, the "edge element" denotes a segment of edge extending from one intersection to another of two different edges. Both the semicircular edge element (p1) and the arcuate edge element (q1) represent the typical examples of the curved edge elements in the present invention.

A detailed description is given below of the arrangement of dimples in the unit triangle (T) according to Example 1. At the center of the unit triangle (T) is formed a non-circular dimple (D3) with three semicircular edge elements (p1). The non-circular dimple (D3), which is approximately triangular, is surrounded by six non-circular dimples (D4) of two kinds of shape. Each of the non-circular dimples (D4) is formed with four carved edge elements, the semicircular edge elements (p1) and the arcuate edge elements (q1). In the vicinity of each vertex is formed a non-circular dimple (D3') surrounded by two semicircular edge elements (p1) and one arcuate edge element (q1). In the vicinity of each vertex is also formed a non-circular dimple (D5') surrounded by five semicircular edge elements (p1). A portion (one-fifth) of the non-circular dimple (D5') is shown at each vertex of the unit triangle (T). On each side of the unit triangle (T) are arranged two non-circular dimples (D4') and two non-circular dimples (D5"), which are halved by the side of the unit triangle (T) as shown. The non-circular dimple (D4') is formed with three semicircular edge elements (p1) and one straight edge element (r1). The non-circular dimple (D5") is formed with two semicircular edge elements (p1), two arcuate edge elements (q1), and one straight edge element (r1). According to this example, all the non-circular dimples, except for that placed at the center of the unit triangle (T), are formed with edges composed of curved edge elements bulging toward the inside of the dimple as viewed from above. The total number of dimples formed on the ball's surface is 332.

In this example, the semicircular edge (p) shown in FIG. 2 should have a diameter (dr) (as viewed from above) such that the ratio of dr/dg (where dg is the diameter of the golf ball) is from 0.14 to 0.45, preferably from 0.14 to 0.3.

Moreover, if the parting line of the mold coincides with the equator of the ball, one of the arcuate edges (q), which is a string connected with the arcuate edge elements (q1), forms a wavy great circle along the equator. Preferably, there should exist at least one wavy or sinusoidal great circle.

Figure 3:
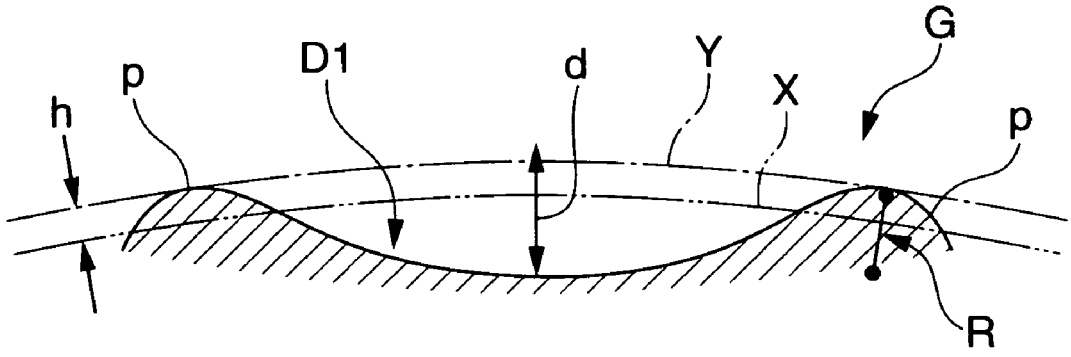
FIG. 3 is a sectional view taken along the line A—A in FIG. 2.

FIG. 3 is a sectional view taken along the line A—A in FIG. 2. It shows the cross section of the dimple and its edges in the example. In this figure, the letter p represents the edge of the dimple. The letter Y represents the outermost peripheral surface (the one-dot chain line connecting the apexes of the edges p to each other) of the ball G. The letter X represents the reference line (the two-dot chain line) drawn concentrically with the one-dot chain line Y. The two chain lines (X and Y) are a distance h apart. The distance h is measured in the radial direction of the ball. The edge p is formed within the distance h, which is 0.01 to 0.20 mm. The cross section of the edge p is not specifically restricted in shape; however, it should preferably be an arc with a radius (R) of 0.2 to 5.0 mm. With an excessively large value of R, the flat part or land will be unduly large, which is unfavorable to aerodynamic properties. With an excessively small value of R, the edges are subject to abrasion by hitting, which leads to poor durability. Incidentally, the reference line X may be positioned at the point of inflection of the arcuate curve (with the radius R extending from the center which is inside the ball) and the curve of the wall extending from the concave bottom of the dimple.

It is desirable that more than 80% (substantially 100%) of the edges (p) demarcating the dimple ($D_1$) have the identical cross section.

In the case shown in FIG. 3, the dimple ($D_1$) extends from the apex of the edge to the deepest part at the center. (The apex of the edge coincides with the one-dot chain line representing the outermost peripheral surface Y). The bottom of the dimple is concave or flat. The depth (d) from the edge (p) of the dimple to the deepest part should preferably be 0.1 to 0.5 mm, particularly 0.15 to 0.35 mm. Dimples shallower than 0.1 mm do not produce the desired effect. Dimples deeper than 0.5 mm increase aerodynamic resistance to reduce flying distance.

Figure 4:
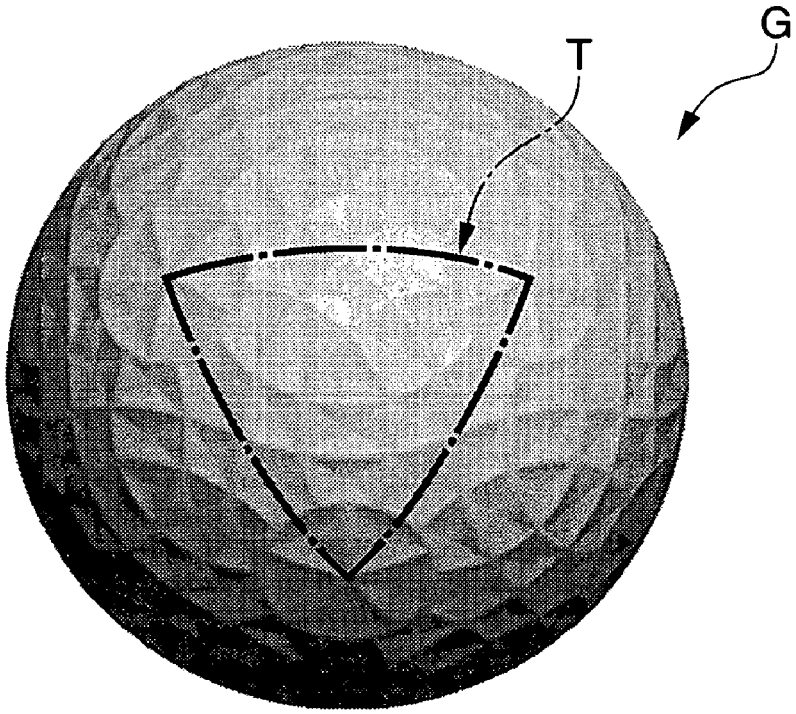
FIG. 4 is a photograph showing the golf ball pertaining to Example 2 of the present invention.
Figure 5:
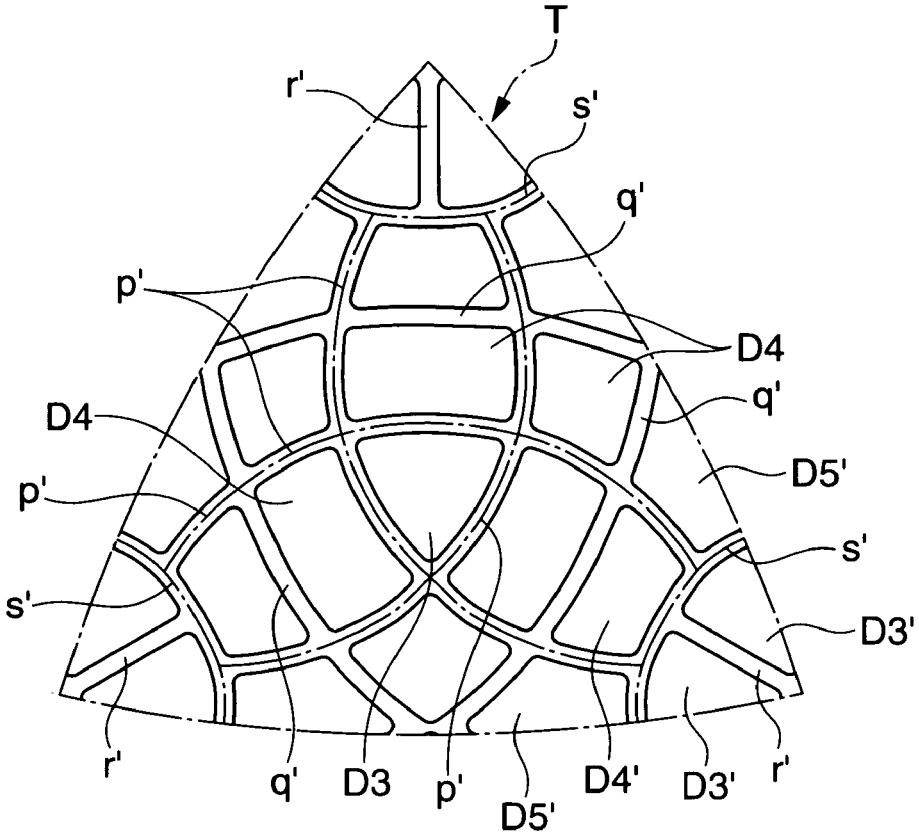
FIG. 5 is a partly enlarged view of the surface of the golf ball shown in FIG. 4.

FIG. 4 is a photograph showing the golf ball pertaining to Example 2 of the present invention. FIG. 5 is a partly enlarged diagram of the photograph shown in FIG. 4. The unit triangle (T) shown in FIG. 5 has the dimple pattern with several features in common with that of Example 1 shown in FIG. 2. The arrangement of dimples in the unit triangle (T) will be described with reference to FIG. 5.

According to Example 2, dimples are arranged as shown in FIG. 5. The letter T denotes the unit triangle as a constituent of a spherical icosahedron. The letter p' denotes a first arcuate edge which is a part of a circle having its center at the middle point of each side of the unit triangle (T). The letter q' denotes a second arcuate edge which is placed outside (in the radial direction) the first arcuate edge p'. The second arcuate edge q' passes through each middle point of two sides of the unit triangle (T). Moreover, the second arcuate edge q' sequentially joins with another one in the adjacent unit triangle (T), thereby forming a wavy line along the great circle on the ball's surface. Each unit triangle (T) has the second arcuate edge q', the third arcuate edge s' (as a part of a circle having its center at each vertex of the unit triangle (T)), and the straight edge r' (which extends from each vertex of the unit triangle (T) to the middle point of the third arcuate edge s'). One unit triangle (T) has three each of the first arcuate edge p', the second arcuate edge q', the third arcuate edge s', and the straight edge r'.

According to Example 2, one unit triangle (T) has several non-circular dimples differing in size and shape which are formed by three, four, and five edge elements of the first arcuate edge p', the second arcuate edge q', the third arcuate edge s', and the straight edge r'.

According to Example 2, dimples in one unit triangle (T) are arranged as explained below in more detail. At the center of the unit triangle (T) is formed the non-circular dimple D3 with three of the first arcuate edge p'. The dimple D3 is surrounded by six non-circular dimples D4, one type of which is formed with three of the first arcuate edge p' and one of the second arcuate edge q', and another type of which is formed with two of the first arcuate edge p' and two of the second arcuate edge q'. The shape of these dimples is the same as that in Example 1. Moreover, in the vicinity of each vertex of the unit triangle (T) are arranged non-circular dimples D3' surrounded by one of the third arcuate edge s' and two of the straight edge r'. Two of the non-circular dimples D3' are symmetrical to each other. On each side of the unit triangle (T) are arranged symmetrically two non-circular dimples D5', each being formed with two of the first arcuate edge p', two of the second arcuate edge q', and one of the third arcuate edge s'. Between these dimples D5', the non-circular dimple D4' is formed with two of the first arcuate edge p', one of the second arcuate edge q', and one of the third arcuate edge s'. According to this example, all the non-circular dimples, except for those placed at the center and the vertexes of the unit triangle (T), are formed with edges composed of curved edge elements bulging toward the inside of the dimple as viewed from above. The total number of dimples formed on the ball's surface is 320.

Figure 6:
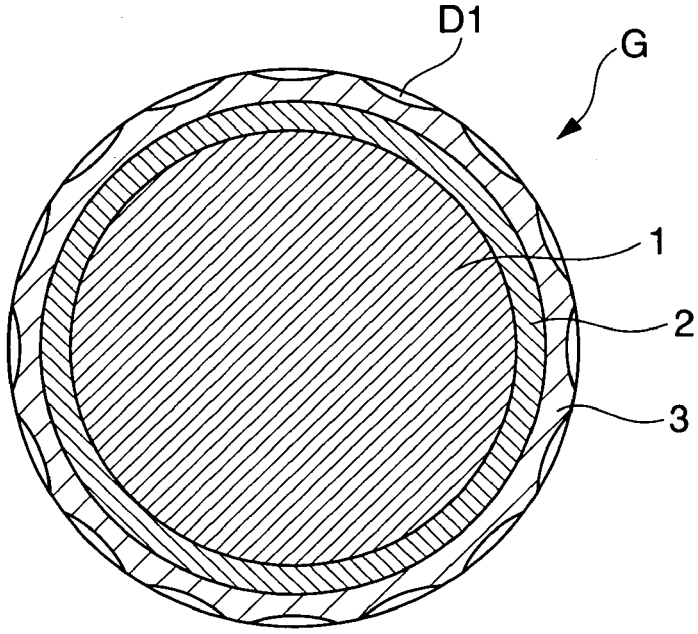
FIG. 6 is a sectional view showing the internal structure of the golf ball.

The foregoing is about the arrangement and configuration of dimples on the ball surface according to Examples. The present invention does not specifically restrict the structure of the golf ball. The present invention is applicable to golf balls of any type, such as solid golf balls and thread-wound golf balls, the former including one-piece golf balls, two-piece golf balls, and multi-piece golf balls with three or more layers. The present invention will fully produce its effect when it is applied to golf balls of multi-layer structure having one or more intermediate layers between the elastic solid core and the cover, as shown in FIG. 6. In FIG. 6, the elastic core, intermediate layer, and cover are denoted by reference numerals 1, 2, and 3, respectively.

The golf ball G shown in FIG. 6 has the elastic core 1 which is made mainly of polybutadiene. This elastic core 1 should have rigidity such that the compressive deflection which it undergoes when it receives an initial load of 98 N (10 kgf) and a final load of 1274 N (130 kgf) is no less than 2.0 mm, preferably no less than 2.5 mm, and no more than 4.5 mm, preferably no more than 4.0 mm, although rigidity is not limited to these values.

The cover 3 may be formed from any known thermoplastic resin or thermosetting polyurethane resin. The intermediate layer 2 may be formed from ionomer resin as a desirable material.

The cover should have a value of Shore D hardness which is no lower than 45, preferably no lower than 50, and no higher than 75, preferably no higher than 63, from the standpoint of spin and rebound resilience, although it is not specifically restricted in hardness.

Also, the intermediate layer should have a value of Shore D hardness which is no lower than 45, preferably no lower than 50, and no higher than 70, preferably no higher than 60, from the standpoint of spin and rebound resilience, although it is not specifically restricted in hardness.

The cover and intermediate layer should have a thickness of 1.0 to 1.5 mm and 1.0 to 2.0 mm, respectively, although they are not specifically restricted in thickness.

The weight and diameter of the golf ball may be adequately established according to Golf Rule.

EXAMPLES

The invention will be described with reference to the following Examples and Comparative Example, which are not intended to restrict the scope thereof.

Examples 1 and 2 and Comparative Example 1

Figure 7:
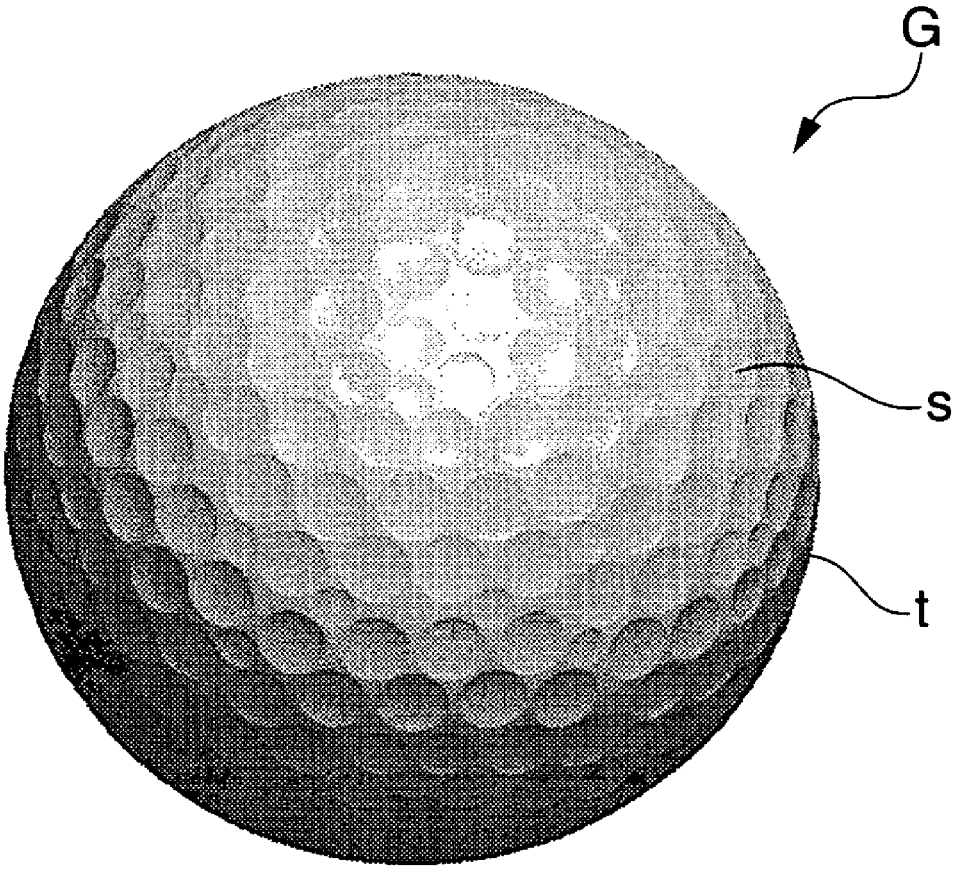
FIG. 7 is a photograph showing the conventional golf ball.

Golf ball samples were prepared, each having dimples arranged as shown in FIG. 1 (Example 1), FIG. 4 (Example 2), and FIG. 7 (Comparative Example 1). They were tested for flight performance. The arrangement of dimples in these examples is based on the spherical icosahedron.

The golf balls in these examples are of three-piece structure consisting of a core (1), a cover (3), and an intermediate layer (2), as shown in FIG. 6. The details of each constituent are given below.

Core

The core was formed from a rubber composition composed of the following components.

Polybutadiene (100 pbw), "BRO1" from JSR Corporation.

Zinc acrylate (25 pbw).

Dicumyl peroxide (0.8 pbw), "Percumyl D2 from NOF Corporation.

1,1-bis(t-butylperoxy)-3,3,5-trimethylcyclohexane (0.8 pbw), "Perhexa 3M-40" from NOF Corporation.

Antioxidant (0.2 pbw), "Nocrac NS-6" from Ouchishinko Chemical Industrial Co., Ltd.

Zinc oxide (25 pbw).
Zinc salt of pentachlorothiophenol (0.5 pbw).
Zinc stearate (5 pbw).

The rubber composition was vulcanized at 160° C. for 20 minutes. The resulting core was tested for rigidity by measuring compressive deflection under a load which was increased from 10 kgf (initial load) to 130 kgf (final load). The measured value was 3.5 mm.

Intermediate Layer and Cover

Using a mold in which the solid core prepared as mentioned above was placed, injection molding was carried out to form the intermediate layer on the core. The material for the intermediate layer was a blend of "Himilan 1605" (ionomer resin from Du Pont-Mitsui Polychemicals Co., Ltd.), "Dynalon E6100P" (polyubtadiene block copolymer from JSR Corporation), and behenic acid (from NOF Corporation). The core enclosed by the intermediate layer was placed in another mold, and injection molding was carried out in this mold to form the cover. The material for the cover was a blend of "Pandex T8295" (thermoplastic polyurethane elastomer from DIC Bayer Polymer Ltd.) and "Crossnate EM-30" (isocyanate master batch from Dainichiseika Color & Chemicals Mfg. CO., Ltd.). The Shore D hardness of the intermediate layer and cover was 56 and 50, respectively.

Ball Testing

The samples of golf balls were examined for flying distance by using a driver (W#1) fixed to a hitting machine which was adjusted so that the initial velocity is 45 m/s and the striking angle is 10°. The results are shown in Table 1.

TABLE 1

| | Example | | Comparative Example |
|---|---|---|---|
| | 1 | 2 | 1 |
| Dimple arrangement | FIG. 1 | FIG. 4 | FIG. 7 |
| Number of dimples | 332 | 320 | 432 |
| Ratio of dimples bulging inside (%) | 94.0 | 75.0 | 0 |

TABLE 1-continued

| | | Example | | Comparative Example |
|---|---|---|---|---|
| | | 1 | 2 | 1 |
| Occupancy of dimples (%) | | about 100 | about 100 | 78 |
| Test results | Carry (m) | 223.7 | 221.5 | 219.2 |
| | Total (m) | 233.3 | 231.7 | 228.8 |

The invention claimed is:

1. A golf ball having a plurality of dimples demarcated by edges on the ball's surface, wherein said dimples each assume a non-circular shape (as viewed from above) with mutually intersecting curved edge elements of said edges, and wherein at least one of these non-circular dimples is demarcated by an edge whose edge element bulges toward an inside of the dimple.

2. The golf ball of claim 1, wherein one of the curved edge elements assumes an arcuate shape.

3. The golf ball of claim 1, wherein said curved edge elements joined together form at least one wavy great circle on the golf ball's surface.

4. The golf ball of claim 3, wherein the wavy great circle coincides with an equator line of the golf ball.

5. The golf ball of claim 1, wherein said edge has a cross section which assumes an arcuate shape.

6. The golf ball of claim 1, wherein said dimples have a maximum depth of 0.1 to 0.5 mm.

7. The golf ball of claim 1, wherein said dimples include non-circular dimples demarcated by three curved edge elements.

8. The golf ball of claim 1, wherein said dimples include non-circular dimples demarcated by four curved edge elements.

* * * * *